United States Patent [19]

Hymans

[11] 4,192,215

[45] Mar. 11, 1980

[54] TENSIONING APPARATUS AND METHOD OF APPLYING TENSION TO A TENDON

[76] Inventor: Nelson J. Hymans, 5116 S. 81st St., Ralston, Nebr. 68127

[21] Appl. No.: 937,377

[22] Filed: Aug. 28, 1978

Related U.S. Application Data

[63] Continuation of Ser. No. 577,691, May 5, 1975, abandoned.

[51] Int. Cl.[2] ..... E04C 3/26; E21B 19/00; F16B 17/00

[52] U.S. Cl. ..... 85/36; 24/122.6; 52/223 L; 254/29 A

[58] Field of Search ..... 85/36, 33, 1 T; 151/19 R; 254/29 A; 52/223 L, 223 R, 230; 24/122.6, 263 D, 136 R, 115 M; 403/374, 369

[56] References Cited

U.S. PATENT DOCUMENTS

| | | | |
|---|---|---|---|
| 1,638,300 | 8/1927 | Gagnon | 151/19 R |
| 1,712,108 | 5/1929 | Goeller | 151/19 R X |
| 2,699,589 | 1/1955 | Redell | 151/19 R |
| 3,309,744 | 3/1967 | Sironi et al. | 24/122.6 |
| 3,387,417 | 6/1968 | Howlett | 24/122.6 X |
| 3,412,511 | 11/1968 | Dietrich | 254/29 A X |
| 3,478,396 | 11/1969 | Drouillard | 52/223 L X |

FOREIGN PATENT DOCUMENTS

| | | | |
|---|---|---|---|
| 985376 | 3/1965 | United Kingdom | 85/36 |

*Primary Examiner*—Ramon S. Britts
*Attorney, Agent, or Firm*—Henderson & Sturm

[57] ABSTRACT

An apparatus and a method are disclosed for inducing torsion-free axial tensile stress in a tendon. The apparatus includes tapered wedge-grippers mounted on the tendon, an externally threaded hollow sleeve member with tapered inner surfaces concentrically mounted on the wedge grippers, and an internally threaded nut placed around the sleeve and in contact with a cooperating bearing surface through which the tendon projects. The sleeve is provided with a head having at least a pair of parallel surfaces which are engagable by a torque wrench for restraining it against rotation as the nut is rotated with a second torque wrench. The resultant movement of the sleeve together with interaction of the members of the apparatus results in torsion-free axial tensile stress in the tendon.

4 Claims, 5 Drawing Figures

TENSIONING APPARATUS AND METHOD OF APPLYING TENSION TO A TENDON

This application is a continuation in part of Ser. No. 577,691 filed May 5, 1975 now abandoned.

BACKGROUND OF THE INVENTION

A plurality of tendon tensioning apparatus are available such as strand chucks, strand vices, and other tendon-engaging devices used with a cooperating hydraulic jack or other means by which the tendon is tensioned by pulling on it. In such apparatus, the tendon-engaging device serves to maintain the tendon tension when the pulling force applied by the hydraulic jack is removed. While such apparatus does afford the means by which torsion-free axial tensile stress may be induced in a tendon, the apparatus and method are useful only when a device for pulling on the tendon is available and also only when the space required for use of such a device is available. This invention is directly primarily to those conditions in which it is desirable or necessary to induce torsion-free axial tensile stress in a tendon or other linear member and in which it is also desirable or necessary to do so without the aid of tendon pulling means, but with only cooperating torque wrenches.

A tendon-engaging device like the one disclosed by Drouillard, U.S. Pat. No. 3,478,396, for example, when used with a torque wrench but without a tendon pulling device, can be used to induce at least some tension in a tendon, but only to the degree to which the tendon by itself is able to resist the torque required to rotate the nut. Newton's Laws and other well known principles of mechanics will show that for each measure of torque applied to the nut to cause it to rotate, there will be a corresponding measure of torque or proportional magnitude induced in the tendon. The result is, therefore, not only axial tensile stress, but also co-existing torsion stress. The amount of torque which can be applied to cause the nut to rotate is therefore limited by the amount of torque which the tendon can tolerate.

The avoiding of also inducing torsion stress in a tendon as it is tensioned is desirable and frequently necessary. In applications involving tendons which are to be highly stressed in tension, co-existing torsion stress is known to limit the magnitude of the tension stress which the tendon can endure without failure and to adversely affect the reliability of the tendon. Some tendon forms, stranded wire or cable for example, may unwind when subjected to torsion stress.

Prior art, Drouillard for example, discloses the use of threads on a sleeve member and the use of the threads for engagement by a threaded coupling device to which a tendon pulling force is applied. Such threaded engagements are not effective in theory or in practice in the avoiding of tendon torsion stress as the nut is rotated because, as is well known in the art, such engagements are provided for the very purpose of accomodating relative rotation of the two parts so engaged and not for the purpose of restraining relative rotation.

The foregoing discussion of representative prior art is included here to illustrate its significant limitations and to call attention to the important and distinctive characteristics of this invention. As can be seen, a need exists for an apparatus and a method which makes it possible in theory and practice to induce torsion-free axial tensile stress in a tendon using only torque wrenches in the process. The present invention is directed to that need.

SUMMARY OF THE INVENTION

This invention relates primarily to an apparatus and a method which can be used for inducing torsion-free axial tensile strength in a tendon where a limited amount of space is available. The apparatus includes a wedge-gripper component having inner surfaces for mating with the outer surface of a tendon or linear object and tapered outer surfaces; a sleeve component having tapered surfaces for mating with the wedge-gripper component's outer surfaces, threaded surfaces, and a wrench engageable surfaces to which external rotational restraint is applied; and a nut which is threadably mounted on the sleeve and which coacts with a bearing surface and upon the application of an external rotational force the tendon is tensioned. A primary application for the apparatus is for connection to the prestressing strand, and/or to provide positive mechanical anchorage to the prestressing strand, and/or to hold a third device against a hardened precast concrete object having a prestressing strand extending therefrom. While the apparatus provided by this invention is of particular utility for the applications mentioned, it is contemplated that it will have many other applications.

It is therefore, an object of this invention to provide an improved tensioning and holding apparatus which can be secured to a tendon and an improved method of applying torsion-free axial tensile stress in that tendon.

Another object of this invention is in general to provide an apparatus and a method for inducing torsion-free axial tensile stress in a tendon and in particular to provide an apparatus and a method with which torsion-free axial tensile stress can be induced in a tendon using torque wrenches.

Other objects of this invention are to provide an apparatus and method with which torque can be used to induce torsion-free axial tensile stress in a tendon; to provide an apparatus with which torque can be effectively utilized to provide tension; and to provide a method in which torque wrenches are used to induce torsion-free axial tensile stress in a tendon.

Another object of this invention is to not only grip a linear object such as a tendon, but also, in combination with a bearing surface, and through the application of external torque, to provide tension to the tendon while, at the same time, avoiding the transmission of all or part of the external torque to the tendon thereby avoiding the rotation or twisting of the linear object.

A further object of this invention is to provide an apparatus which is particularly suitable for gripping a prestressing strand which extends from a precast prestressed concrete object, and to also, if desired, be used to retension the prestressing strand. Yet another object of this invention is the provision of an apparatus which can provide reliable positive mechanical anchorage to a prestressing strand at or near the end of a hardened precast prestressed concrete object.

Still a further object of this invention is to provide an apparatus which can be used to provide tension-free axial tensile stress in a tendon which is extremely effective in use, durable of construction, and economical of the manufacture.

These objects and other features and advantages of this invention will become readily apparent upon reference to the following description when taken in conjunction with the accompanying drawings.

BRIEF DESCRIPTION OF THE DRAWINGS

In the drawings, although various modifications and alternate constructions can be made thereto without departing from the true spirit and scope of the invention, a preferred embodiment of the invention is illustrated, wherein.

DESCRIPTION OF THE PREFERRED EMBODIMENTS

Figure 1:
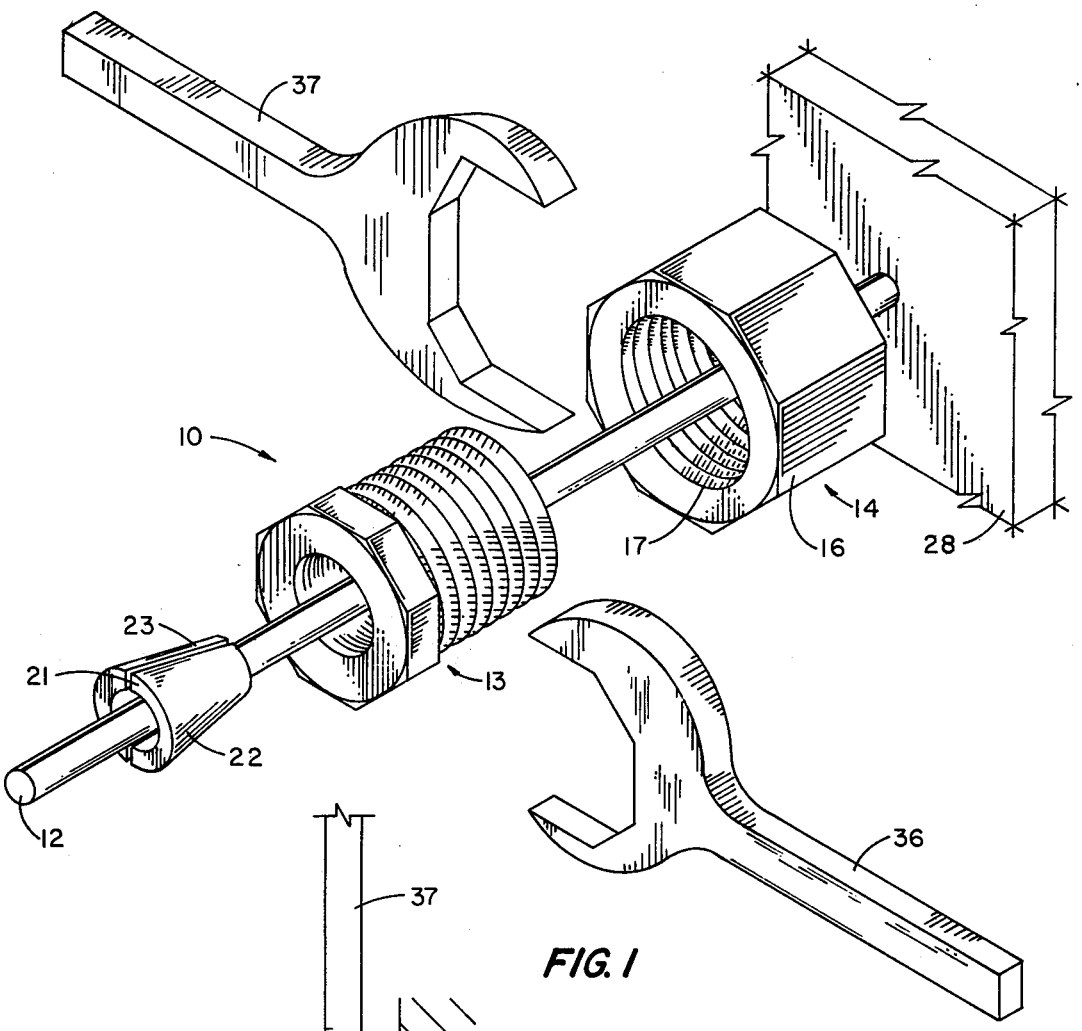
FIG. 1 is an exploded perspective view of the tensioning apparatus of this invention.
Figure 2:
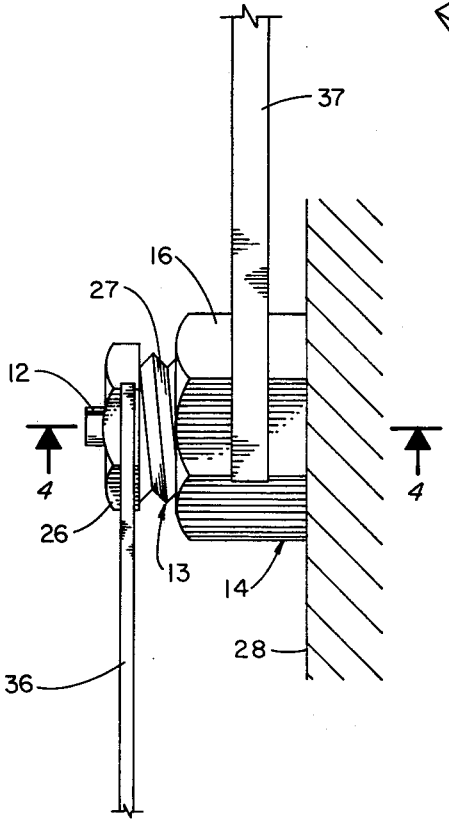
FIG. 2 is a side elevational view thereof as depicted when secured to a linear object.

Referring now to FIGS. 1–5, a preferred embodiment of the tensioning apparatus of this invention is shown generally at 10. The apparatus 10 comprises a wedge gripper component 11 disposed on a tendon or linear object 12, such as a cable, rod, wire, tube or the like; a sleeve 13 slidably mounted on the wedge gripper unit 11, and a conventional nut 14 having an octagonal outer surface 16 and a tapped inner surface 17.

The wedge gripper component 11 (FIGS. 1 and 4) is formed from a frusta-conical element 18 having a hole 19 formed axially therethrough and which has at least one slit formed longitudinally therethrough.

The surface formed by the hole 19 in the wedge gripper component 11 is scored to permit it to grip or lock onto the tendon 12. A pair of slits are cut longitudinally through the component 11 to form two wedge grippers 22 and 23. However, it should be noted that the invention is not limited to only two wedge grippers as three or more may be necessary, particularly if the tendon is large or non-uniform in cross section.

Figure 3:
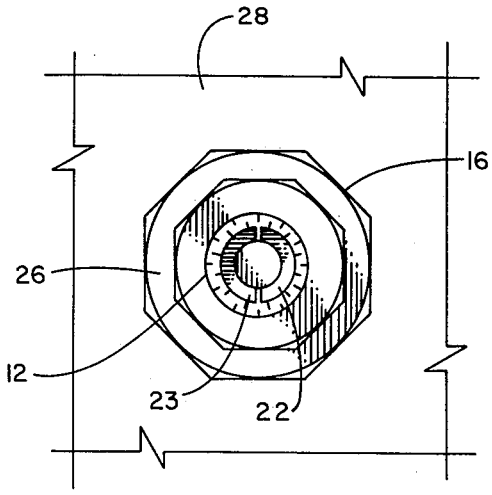
FIG. 3 is a front elevational view thereof.

The sleeve component 13 has a tapered hole 24 drilled axially therethrough. A wrench engageable head 26, such as an octagonal head, as shown in FIG. 3, is formed on the head end of the sleeve component and the shank end 27 is threaded (FIG. 1).

Figure 4:
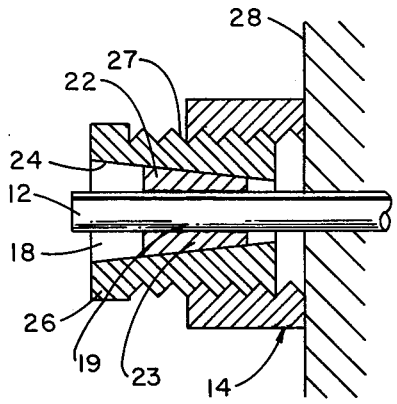
FIG. 4 is a sectional view taken along the lines 4—4 in FIG. 2.
Figure 5:
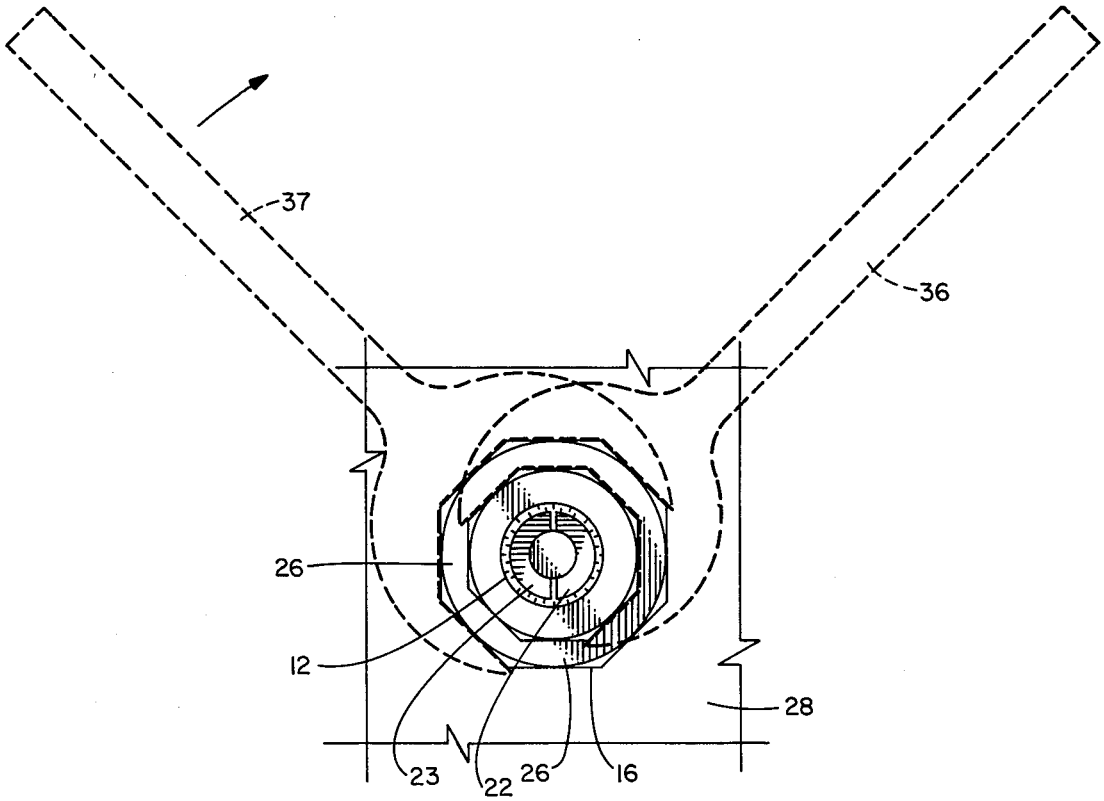
FIG. 5 is a front elevational view thereof with a pair of torque wrenches, depicted in broken line, engaging the sleeve and nut of the invention.

Referring to FIG. 4, the apparatus 10 is shown mounted on the tendon 12 with the nut 14 bearing on a surface 28 through which the tendon 12 projects. In use (FIGS. 1, 2 and 5), the nut 14 is mounted on the tendon 12 with one end thereof bearing against the surface 28. The sleeve component 13 is threaded into the nut 14, the wedge grippers 22 and 23 are placed around the tendon 12 and slid into the sleeve component 13 wherein they engage the tendon 12 as the tapered outer surfaces slide into and along the tapered inner surface of the sleeve component 13. A first, fixed jaw or torque wrench 36 is applied to parallel surfaces of the wrench engageable head 26 of the sleeve with the outer end of the wrench 36 projecting radially of the tendon. The outer end of the wrench is externally restrained to prevent any rotation of the sleeve component 13. A second fixed jaw or torque wrench 37 is applied to parallel surfaces of the nut 14 with the outer end of the wrench 37 projecting radially of the tendon. Torque, acting in a plane generally perpendicular to the axis of the tendon, is then applied to the nut 14 in the direction depicted by the arrow in FIG. 5. Rotation of the nut 14 causes axial movement of the sleeve component 13 away from the surface 28, interaction of the inner tapered surface of the sleeve component with the outer tapered surface of the wedge grippers 22 and 23, and thereby torsion-free axial tensile stress in the tendon 12. This application of torsion-free axial tensile stress can readily be accomplished with the apparatus and wrenches in a minimal amount of space.

I claim:

1. A tensioning apparatus adapted for employment with two torque wrenches coacting with only a plane surface of a body to induce torsion-free axial tensile stress in a linear member which extends from the body generally perpendicularly to the plane surface, the apparatus comprising:

wedge gripper means having an opening formed axially therethrough for generally concentric mounting on the linear member, an inner surface for gripping engagement of the linear member, and a tapered outer surface;

a sleeve member having an opening formed axially therethrough for generally concentric mounting on said wedge gripper means, a tapered inner surface for mateable contact and interaction with wedge gripper means tapered outer surfaces, and an outer surface with screw threads formed on a reduced diameter portion thereof and a separate and distinct integrally formed enlarged wrench engageable surface formed on another portion thereof for positive mateable mechanical engagement by one of the two wrenches, the enlarged wrench engagable surface having an outer dimension greater than the maximum thread diameter; and a nut having an opening formed axially therethrough from end to end thus providing an inner surface with the inner surface having screw threads formed thereon for threadable contact with said sleeve member's threaded surface, an integral, enlarged wrench engageable surface formed on the outer surface thereof for positive mateable mechanical engagement by the other of the two wrenches, and a plane surface formed on one end thereof for mateable contact with the plane surface of the body, wherein said enlarged wrench engageable surfaces on said sleeve member and said nut cooperate to limit the travel of the threaded portion of the nut on the threaded portion of the sleeve in one direction only.

2. The apparatus of claim 1 and said wedge gripper means includes at least a pair of spaced wedge grippers disposed in side by side relation about the linear member with each having an inner surface for engagement with the linear member and an outer tapered surface.

3. The apparatus of claim 2 and said wrench engagable surface of said sleeve member includes parallel surfaces engagable by the one torque wrench.

4. A method of applying tension to a linear member projecting from a bearing surface, the method comprising the steps of:

(a) providing at least a pair of spaced wedge grippers disposed in side by side relation about the linear member each gripper having an inner surface for engagement with the linear member and a tapered outer surface;

(b) providing a sleeve member having an opening formed axially therethrough for generally concentric mounting on the linear member over the wedge grippers, the sleeve having a tapered inner surface for mateable contact and interaction with the wedge grippers outer tapered surface and a outer surface with screw threads formed on a reduced diameter portion thereof and an integrally formed enlarged wrench engagable surface formed on another portion thereof for positive mechanical engagement by a first torque wrench the enlarged wrench engagable surface having an outer dimension greater than the maximum thread diameter;

(c) providing a nut having an opening formed therethrough from end to end thus providing an inner surface with the inner surface having screw theads formed thereon for threadable contact with the sleeve member's threaded surface, an enlarged integral wrench engagable surface formed on the outer surface for positive mateable mechanical engagement by a second torque wrench, and a plane surface formed on one end thereof for mateable contact with the bearing surface;

(d) mounting the nut concentrically on the linear surface with the plane surface thereof in mateable contact with the bearing surface;

(e) mounting the sleeve member concentrically on the linear member, and threadably mounting the sleeve member in the nut;

(f) mounting the wedge grippers about the linear member and sliding them into the sleeve with the wedge grippers inner surface gripping the linear member and the tapered outer surface in mateable contact with the tapered inner surface of the sleeve member;

(g) engaging the sleeve member's wrench engaging surfaces by the first torque wrench;

(h) engaging the nut's wrench engaging surface by the second torque wrench;

(i) externally restraining the first torque wrench against rotation; and (j) applying torque to the second torque wrench in a plane generally perpendicular to the axis of the linear member to cause rotation of the nut about the linear member in one direction and thus provide axial movement of the sleeve member and the wedge grippers away from the bearing surface which provides torsion-free axial tensile stress in the linear member, while axial rotation of the nut in the other direction, will result in a limited travel of the nut on the sleeve to the point where the integral enlarged wrench engagable surfaces on the nut and sleeve contact with one another.

* * * * *